US010016342B2

(12) United States Patent
Kempker et al.

(10) Patent No.: US 10,016,342 B2
(45) Date of Patent: Jul. 10, 2018

(54) NIPPLE-SHAPED PACIFIER KIT

(71) Applicants: Kortnie Kempker, Cheyenne, WY (US); Dylan Kempker, Cheyenne, WY (US)

(72) Inventors: Kortnie Kempker, Cheyenne, WY (US); Dylan Kempker, Cheyenne, WY (US)

(73) Assignees: Kortnie Kempker, Holts Summit, MO (US); Dylan Kempker, Holts Summit, MO (US)

( * ) Notice: Subject to any disclaimer, the term of this patent is extended or adjusted under 35 U.S.C. 154(b) by 408 days.

(21) Appl. No.: 14/883,611

(22) Filed: Oct. 14, 2015

(65) Prior Publication Data

US 2016/0101025 A1 Apr. 14, 2016

Related U.S. Application Data

(60) Provisional application No. 62/063,466, filed on Oct. 14, 2014.

(51) Int. Cl.
*A61J 11/00* (2006.01)
*A61J 17/00* (2006.01)

(52) U.S. Cl.
CPC ..... *A61J 11/005* (2013.01); *A61J 17/001* (2015.05)

(58) Field of Classification Search
CPC .. A61J 11/0045; A61J 11/005; A61J 11/0055; A61J 17/00; A61J 17/001; A61J 17/008; B31D 5/0039; D21J 3/12
USPC ..... 606/234, 236
See application file for complete search history.

(56) References Cited

U.S. PATENT DOCUMENTS 1,716,262 A * 6/1929 Dishart ..... A61J 11/008 215/11.6
2,084,689 A * 6/1937 Karl ..... A61J 11/0055 215/11.6
2,824,561 A * 2/1958 Mueller ..... A61J 17/006 215/11.1
3,217,067 A * 11/1965 Tencate ..... A61C 13/04 264/18
3,825,014 A * 7/1974 Wroten ..... A61J 17/001 606/236
4,280,695 A * 7/1981 Stenehjem ..... A61F 2/18 428/15
4,335,067 A * 6/1982 Castanis ..... A61F 2/586 264/222
4,352,390 A * 10/1982 Larson ..... B22C 1/00 164/351
4,735,754 A * 4/1988 Buckner ..... A61F 2/5046 156/62
4,796,628 A * 1/1989 Anderson ..... A61J 15/0011 606/236
4,828,116 A * 5/1989 Garcia ..... B44C 3/042 206/575
5,004,473 A * 4/1991 Kalantar ..... A61J 11/0035 215/11.1
5,108,686 A * 4/1992 Griffin ..... A61J 11/005 215/11.1

(Continued)

*Primary Examiner* — Matthew J Daniels
*Assistant Examiner* — Andrew D Graham

(57) ABSTRACT

A nipple-shaped pacifier kit provides hypoallergenic molding powder, liquid silicone, a mixing bowl, a mixing tool, pacifier rings, and paper discs, each providing a slit for the insertion of the pacifier ring. The kit enables the adult user to create one or more pacifiers shaped like the human nipple.

4 Claims, 2 Drawing Sheets

(56) References Cited

U.S. PATENT DOCUMENTS

| | | | | | |
|---|---|---|---|---|---|
| 5,395,392 | A * | 3/1995 | Suhonen | A61J 7/0046 | 604/77 |
| 5,695,066 | A * | 12/1997 | Bartlett | B44C 3/042 | 206/575 |
| 5,810,003 | A * | 9/1998 | Findlater | A61M 15/00 | 128/200.14 |
| 5,873,892 | A * | 2/1999 | Cohen | G01K 11/12 | 374/151 |
| 6,112,749 | A * | 9/2000 | Hall | A61J 11/003 | 128/898 |
| 7,600,647 | B2 | 10/2009 | Strickler | | |
| 2003/0032984 | A1* | 2/2003 | Hakim | A61J 11/0055 | 606/234 |
| 2003/0143261 | A1* | 7/2003 | Noda | A61K 8/85 | 424/443 |
| 2004/0040556 | A1* | 3/2004 | Fillyaw | A61M 16/0488 | 128/202.16 |
| 2006/0036285 | A1* | 2/2006 | Davis | A61J 17/001 | 606/234 |
| 2006/0083710 | A1* | 4/2006 | Joerger | A01N 43/16 | 424/76.1 |
| 2006/0201901 | A1* | 9/2006 | Sabree | A61J 17/001 | 215/11.1 |
| 2008/0314776 | A1* | 12/2008 | Cooke | A61J 11/005 | 206/223 |
| 2009/0108009 | A1* | 4/2009 | Yeung | A61J 9/00 | 220/737 |

* cited by examiner

NIPPLE-SHAPED PACIFIER KIT

CROSS-REFERENCE TO RELATED APPLICATIONS

This Application claims the benefit of U.S. Provisional Application No. 62/063,466 filed Oct. 14, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to infant and child care accessories, and in particular to a nipple-shaped pacifier kit. For mothers who breast feed their babies, the use of a pacifier is a poor substitute since it is not shaped like the mother's breast. For many infants, a pacifier which is shaped like the nipple of the mother's breast may be more soothing and pacifying. Certain room temperature vulcanizing (RTV) silicone rubbers are excellent molding materials for the purpose of providing precise surface detail. In addition to their excellent reproduction characteristics, RTV silicones exhibit low shrinkage in a range from 0 to 0.006 inches per inch, and elongation ranging from 100 to 1000 percent. However, there is a limit as to the thickness that a silicone mold can be made, because during solidification the silicone becomes self-deforming due to its own weight. A nipple-shaped pacifier kit, which enables parents to easily make pacifiers from RTV silicone shaped like the mother's nipple, would resolve this problem.

SUMMARY OF THE INVENTION

Accordingly, the invention is directed to a nipple-shaped pacifier kit. The kit provides hypoallergenic molding powder, liquid silicone, a mixing bowl, a mixing tool, pacifier rings, and paper discs, each providing a slit for the insertion of the pacifier ring. The kit enables the adult user to create one or more pacifiers shaped like the human nipple.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
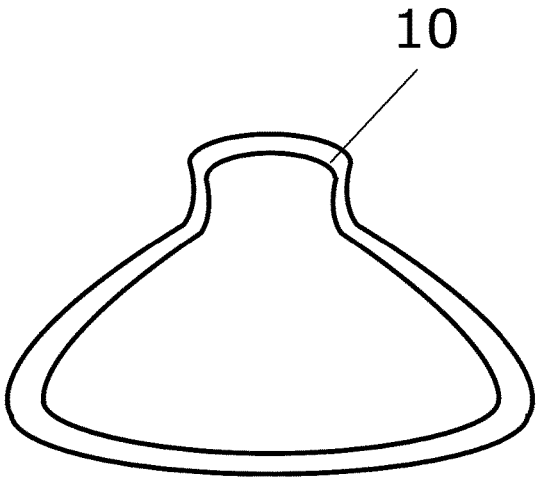
FIG. 1 is a front view of the clay mold component of the first exemplary embodiment, displaying the pacifier ring 10.
Figure 2:
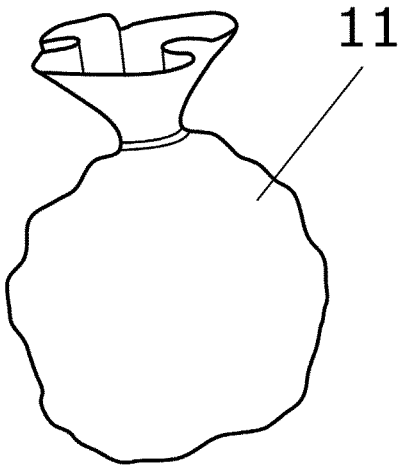
FIG. 2 is a front view of the molding powder component of the first exemplary embodiment, displaying the molding powder 11.
Figure 3:
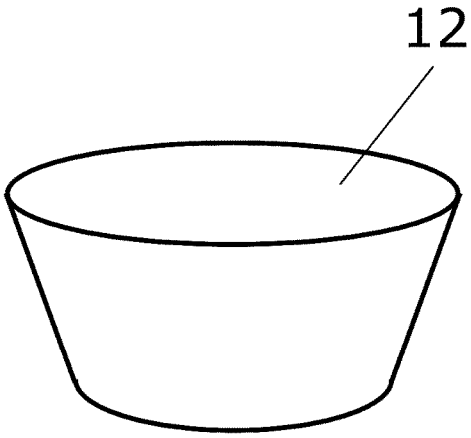
FIG. 3 is a front perspective view of the mixing bowl component of the first exemplary embodiment, displaying the mixing bowl 12.
Figure 4:
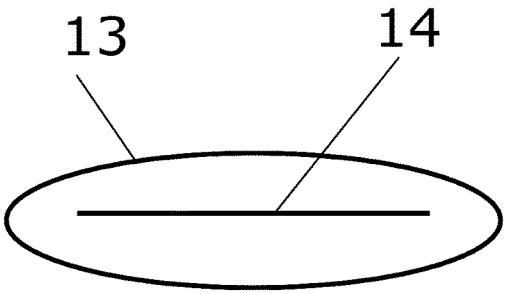
FIG. 4 is a front perspective view of the paper disc component of the first exemplary embodiment, displaying the paper disc 13, and the slit 14.
Figure 5:
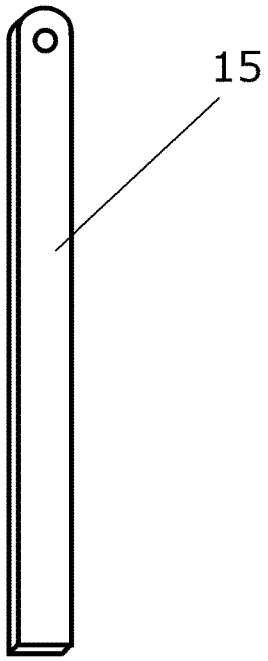
FIG. 5 is a front view of the mixing tool component of the first exemplary embodiment, displaying the mixing tool 15.
Figure 6:
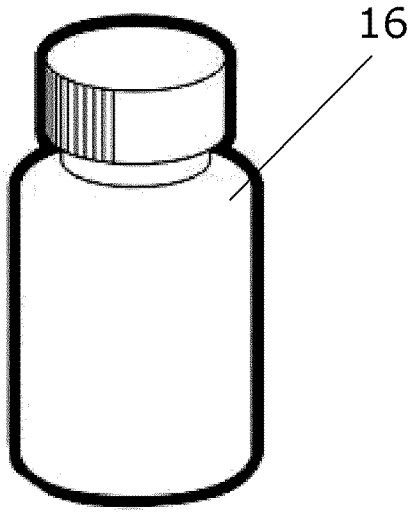
FIG. 6 is a front perspective view of the silicone component of the first exemplary embodiment, displaying the silicone 16.

Referring now to the invention in more detail, the invention is directed to a nipple-shaped pacifier kit. The kit enables the adult user to create one or more pacifiers shaped like the human nipple. The pacifier is comprised of a silicone nipple, molded to conform to the shape of the nipple of the human breast, and bonded to a rigid pacifier ring 10.

The first exemplary embodiment is comprised of a kit, consisting of six components: a plurality of pacifier rings 10, molding powder 11, a mixing bowl 12, a plurality of paper discs 13, a mixing tool 15, and a bottle of liquid silicone 16.

The molding powder 11 is provided in a plastic bag and is hypoallergenic and completely safe for use on human skin. Each of the paper discs 13 provides a slit 14 for the insertion of a pacifier ring 10.

To use the first exemplary embodiment, the user makes a mold of the user's nipple, by using the mixing tool 15 to mix the molding powder 11 with water mixing in the mixing bowl 12, all of the components are provided in the kit, After the molding powder 11 has been liquefied, the user will then place the breast into the mixing bowl 12 where it remains until the mold has hardened. The user then pours the liquid silicone 16 into the mold which has been previously formed. The user inserts the pacifier ring 10 into the slit of the paper disc 13 and subsequently places the pacifier ring 10 into the silicon 16 which is inside of the formed mold, the user should ensure that the paper disc 13 does not touch the silicone 16. The silicone 16 is then allowed to solidify. After the silicone 16 has solidified, the user removes the pacifier from the formed mold.

The pacifier ring 10 is preferably manufactured from a rigid, durable material which is easily cleaned, such as plastic. The molding powder 11 is preferably manufactured from fine-grained, hypoallergenic particulate material such as alginate powder. The mixing bowl 12 and the mixing tool 15 are preferably manufactured from a rigid, disposable material such as plastic. The paper discs 13 are preferably manufactured from a flexible, durable material such as paper.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

We claim:

1. A pacifier manufacturing kit, comprising:

(a) a plurality of pacifier rings;

(b) molding powder, which may be mixed with water into a paste;

(c) a mixing bowl;

(d) a plurality of paper discs, each providing a slit at the center for the insertion of one of said pacifier rings;

(e) a mixing tool; and (f) a bottle of liquid silicone.

2. The pacifier manufacturing kit of claim 1, wherein the molding powder is hypoallergenic.

3. The pacifier manufacturing kit of claim 1, wherein the molding powder is provided in a plastic bag.

4. A pacifier manufacturing method employing a pacifier manufacturing kit, wherein the kit comprises: a plurality of pacifier rings; molding powder, which may be mixed with water into paste; a mixing bowl; a plurality of paper discs, each providing a slit at the center for the insertion of one of said pacifier rings; a mixing tool; and a bottle of liquid silicone; wherein the method comprises:

(a) pouring said molding powder into said mixing bowl;

(b) adding water to said mixing bowl;

(c) using said mixing tool to mix said molding powder and said water into a paste;

(d) placing a user's nipple into said mixing bowl such that the nipple creates a physical impression in said paste;

(e) allowing said paste to harden, permanently retaining said impression;

(f) pouring said liquid silicone into said impression such that said impression is filled;

(g) inserting one of said pacifier rings into the slit at the center of one of said paper discs;

(h) inserting said pacifier ring into said liquid silicone in said impression, such that said paper disc does not contact said liquid silicone;

(i) allowing said liquid silicone to solidify; and (j) after solidification of said liquid silicone, removing the completed pacifier from said impression.

* * * * *